US007546973B2

(12) United States Patent
Budz et al.

(10) Patent No.: US 7,546,973 B2
(45) **Date of Patent: *Jun. 16, 2009**

(54) LOW RESERVE INDICATOR FOR A PAPER TOWEL DISPENSER

(75) Inventors: Gregory D. Budz, Sobieski, WI (US); Thomas N. Kershaw, Neenah, WI (US); John R. Moody, Winlock, WA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/202,597

(22) Filed: Sep. 2, 2008

(65) Prior Publication Data

US 2009/0001212 A1 Jan. 1, 2009

Related U.S. Application Data

(60) Division of application No. 11/066,135, filed on Feb. 23, 2005, now Pat. No. 7,434,760, which is a division of application No. 10/359,168, filed on Feb. 6, 2003, now Pat. No. 6,908,059, which is a continuation-in-part of application No. 09/713,317, filed on Nov. 16, 2000, now Pat. No. 6,517,025.

(51) Int. Cl.
*B65H 26/00* (2006.01)

(52) U.S. Cl. ..... 242/563; 242/593; 242/912; 221/6

(58) Field of Classification Search ..... 242/563, 242/563.2, 590, 593, 912; 221/6; 116/243; 312/234

See application file for complete search history.

(56) References Cited

U.S. PATENT DOCUMENTS

| | | | | |
|---|---|---|---|---|
| 1,738,721 | A | 12/1929 | Morin | |
| 2,601,956 | A | 7/1952 | Birr | |
| 3,260,402 | A * | 7/1966 | Lareau et al. | 221/6 |
| 3,273,773 | A | 9/1966 | Eder | |

(Continued)

FOREIGN PATENT DOCUMENTS

DE 4225164 A1 2/1994

(Continued)

OTHER PUBLICATIONS

European Search Report that issued Feb. 20, 2003, in connection with European Patent Application No. 01309699.5.

*Primary Examiner*—William A Rivera
(74) *Attorney, Agent, or Firm*—Joel T. Charlton

(57) ABSTRACT

A paper towel dispenser includes a housing with an inner chamber configured to support a paper supply and a dispensing aperture for dispensing paper from the paper supply. The paper supply includes a side that is formed by superimposed edge portions of paper from the paper supply. An indicator mechanism is affixed to the housing within the inner chamber and is disposed adjacent the paper supply. The indicator mechanism includes an indicator operably connected to a release mechanism. The indicator is movable between a retracted position and an indicating position. The release mechanism is pivotally biased away from the housing and is releasable in response to the paper supply being reduced below a predetermined amount. Upon release of the release mechanism, the release mechanism causes the indicator to move to the indicating position.

4 Claims, 8 Drawing Sheets

U.S. PATENT DOCUMENTS

| | | | | |
|---|---|---|---|---|
| 3,292,170 | A | 12/1966 | D'Angelo | |
| 4,204,180 | A | 5/1980 | Usui et al. | |
| 4,566,581 | A | 1/1986 | Martin | |
| 4,756,485 | A | 7/1988 | Bastian et al. | |
| 4,760,970 | A | 8/1988 | Larsson et al. | |
| 5,236,348 | A * | 8/1993 | Fetherolf et al. | 221/6 |
| 5,765,718 | A | 6/1998 | Grasso et al. | |
| 5,884,861 | A | 3/1999 | Hosomi et al. | |
| 6,089,499 | A | 7/2000 | Robinson | |
| 6,267,321 | B1 | 7/2001 | Tramontina | |
| 6,321,963 | B1 | 11/2001 | Gracyalny et al. | |
| 6,328,252 | B1 | 12/2001 | Neveu et al. | |
| 6,517,025 | B1 * | 2/2003 | Budz | 242/563 |
| 6,695,247 | B2 | 2/2004 | Widlund | |
| 6,908,059 | B2 * | 6/2005 | Budz et al. | 242/563 |
| 7,434,760 | B2 * | 10/2008 | Budz et al. | 242/563 |
| 2002/0113162 | A1 | 8/2002 | Fournier et al. | |
| 2004/0035976 | A1 | 2/2004 | Byrd et al. | |

FOREIGN PATENT DOCUMENTS

| | | | |
|---|---|---|---|
| EP | 0836825 | A1 | 4/1998 |

* cited by examiner

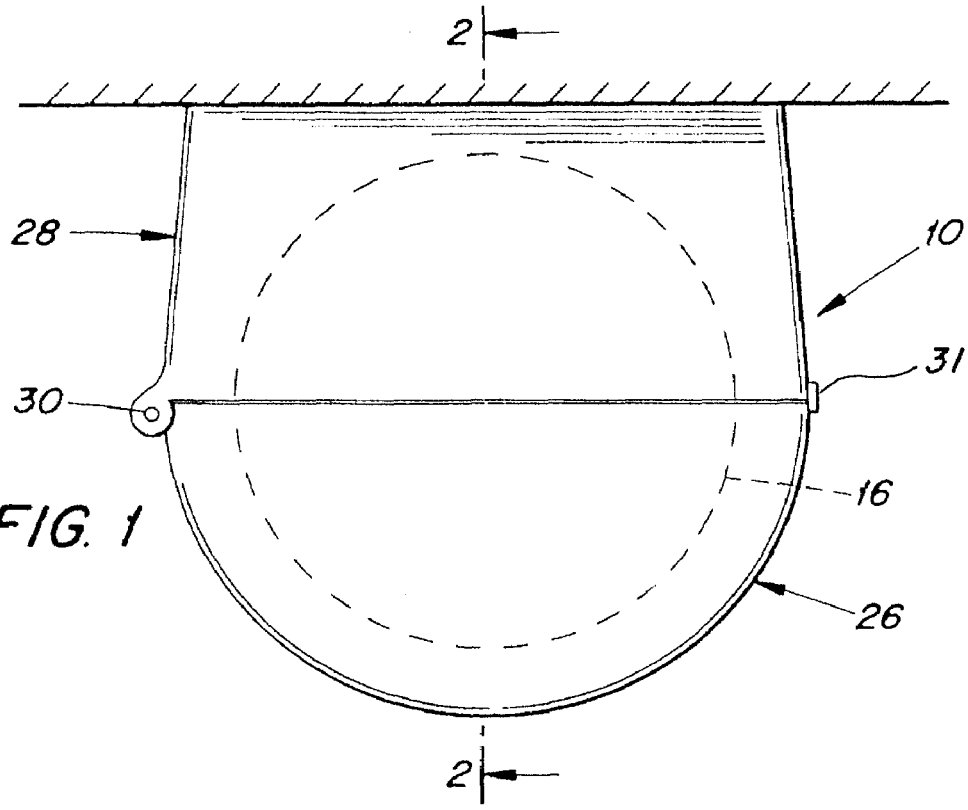
FIG. 1
FIG. 2
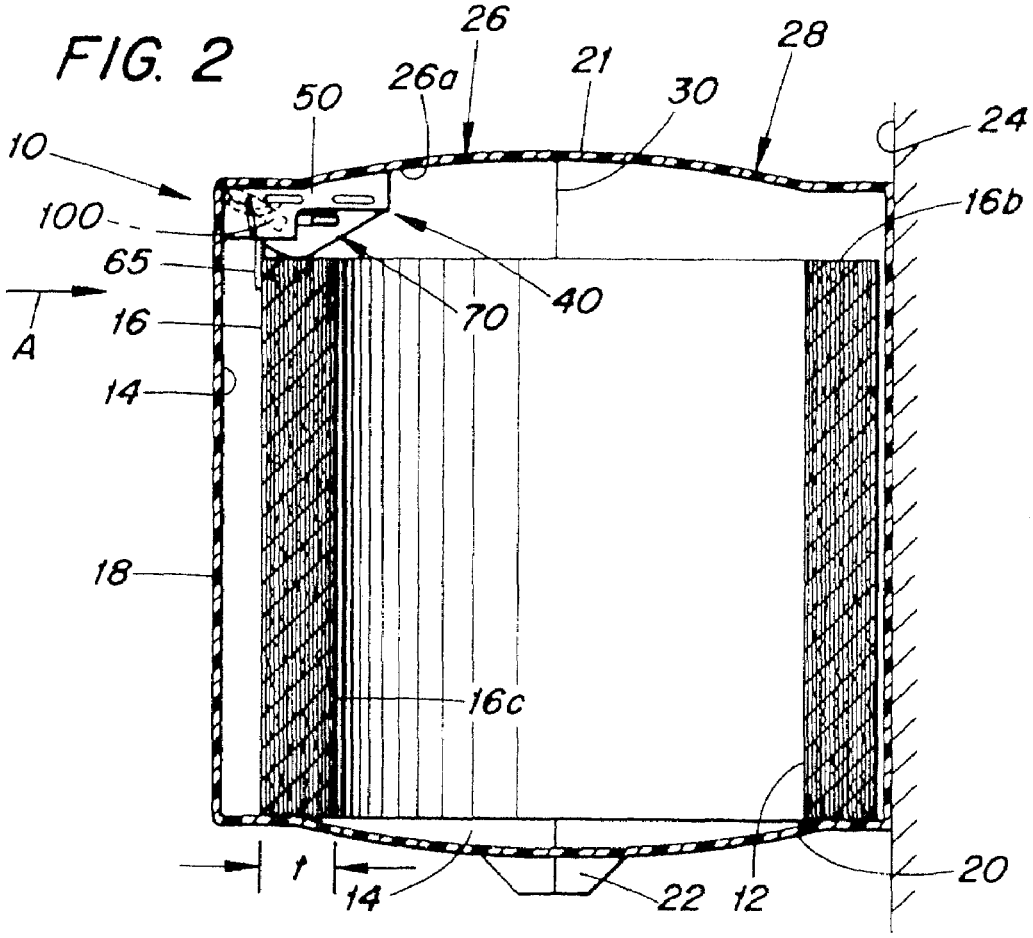

FIG. 10
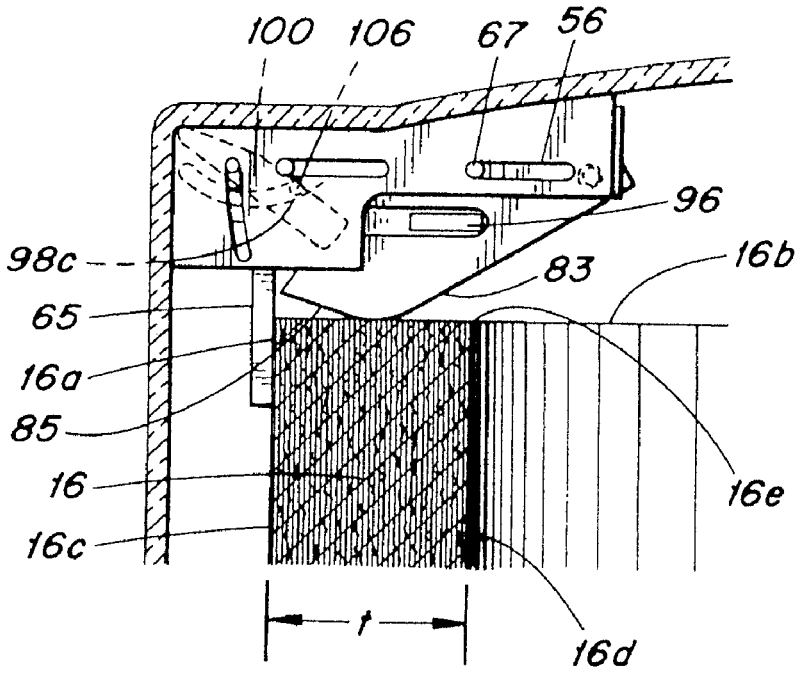
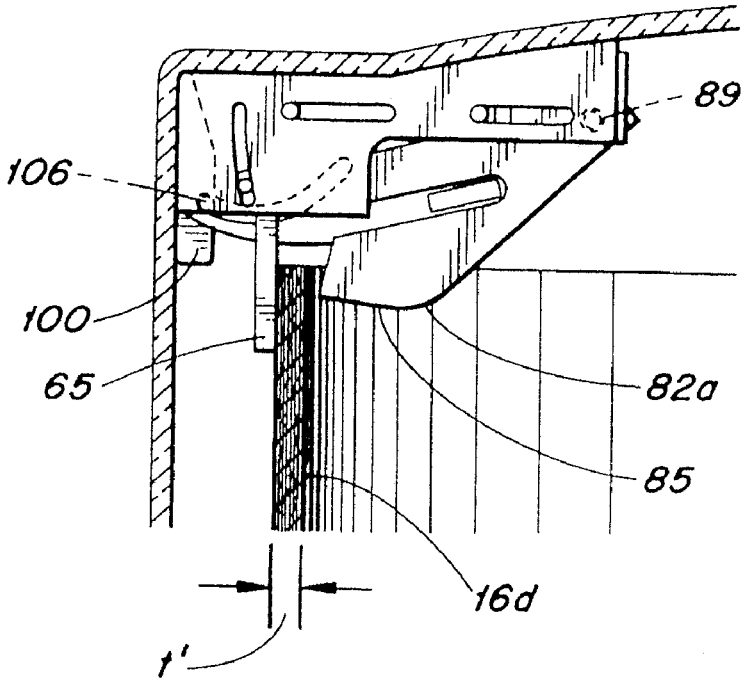
FIG. 11

FIG. 12
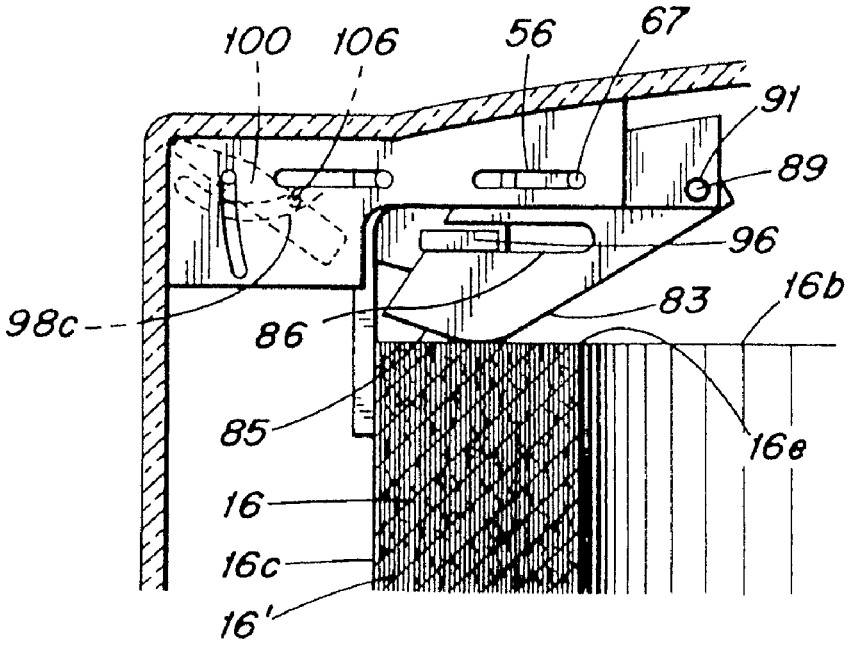
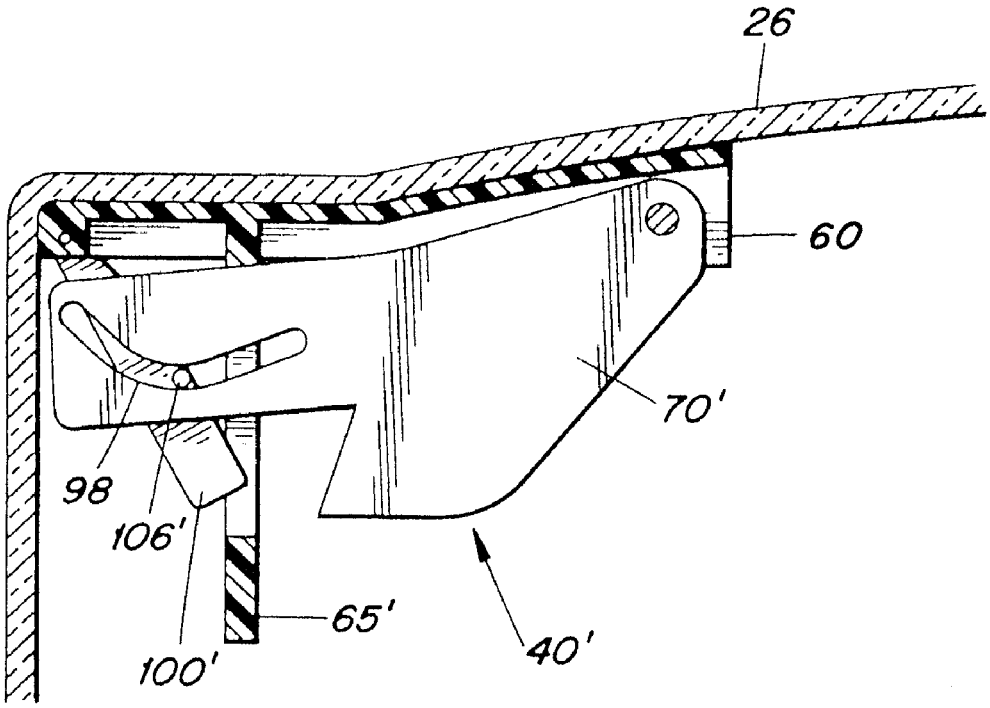
FIG. 15

LOW RESERVE INDICATOR FOR A PAPER TOWEL DISPENSER

CROSS REFERENCE TO RELATED APPLICATION

This application is a division of U.S. application Ser. No. 11/066,135, filed Feb. 23, 2005, which is a division of U.S. application Ser. No. 10/359,168 filed Feb. 6, 2003, now U.S. Pat. No. 6,908,059, which is a continuation-in-part of U.S. application Ser. No. 09/713,317, filed Nov. 16, 2000, now U.S. Pat. No. 6,517,025. The priorities of the foregoing applications are hereby claimed and the entirety of their disclosures incorporated herein by reference.

FIELD OF THE INVENTION

The field of the present invention is indicators for alerting users that the paper reserve in a paper towel dispenser is low.

BACKGROUND OF THE INVENTION

It is conventional to dispense paper towels from an upright roll, that is, a roll whose center axis is oriented vertically. The center of the roll is coreless, so the paper can be pulled from the inner periphery of the roll, that is, usually downwardly through a hole formed in a floor of a dispenser housing. Therefore, the radial thickness of the roll gradually diminishes from a roll inner periphery toward a roll outer periphery. Eventually, only a very small radial thickness of the roll remains.

It is also conventional to dispense paper towels from a vertical stack of individual towels or from a horizontal roll that rotates about a horizontal axis.

It is desirable for the user to be informed when the paper reserve is low in dispensers of the above-described types.

Low-reserve indicators have been previously proposed for paper towel dispensers of the type wherein individual towels are arranged in a vertical stack (see U.S. Pat. No. 1,738,721), or in a horizontal roll (see U.S. Pat. Nos. 2,601,956 and 3,273,773). In U.S. Pat. No. 1,738,721, the low reserve indicator includes a follower roller which rests upon the top of the stack and travels downwardly as the stack is depleted. The roller is attached by a lever arm to a pointer which is visible through a window disposed in a upper portion of the dispenser housing. The pointer rotates as the roller descends, in order to traverse a space between an "empty" indicia and a "full" indicia. Shortcomings of such an indicator include the fact that the roller must be manually held in a raised state by an operator who is loading fresh towels in the dispenser, thus complicating the re-filling operation. Also, the lever must be relatively long in order to extend between the pointer and the roller when the roller is at its lowermost state, whereby the expense, weight, size etc. of the indicator are greater than would be desired.

In each of U.S. Pat. Nos. 2,601,956 and 3,273,773, a relatively long indicator arm must be provided in order to extend to an outer cylindrical periphery of a paper roll U.S. Pat. No. 2,601,956, or in order to extend along and past the entire longitudinal length of the paper roll U.S. Pat. No. 3,273,773. Such long elements increase the overall cost of providing a low reserve indicator mechanism.

Also, it will be appreciated that the low reserve indicators described above are not suitable to a vertically oriented roll, let alone a coreless roll whose towels are pulled from the inner periphery of the roll.

SUMMARY OF THE INVENTION

The present invention is directed toward a paper dispenser which comprises a housing and an indicator mechanism affixed to the housing. The housing includes an inner chamber configured to support a paper supply. The paper supply has a side that is formed by superimposed edge portions of paper from the paper supply. The indicator mechanism includes an indicator operably connected to a release mechanism. The indicator is movable between an retracted position and an indicating position. The release mechanism is pivotally biased away from the housing and is releasable in response to the paper supply being reduced below a predetermined amount. Upon release, the release mechanism causes the indicator to move to the indicating position.

Accordingly, the present invention provides an improved paper dispenser. Other objects and advantages will appear hereinafter.

BRIEF DESCRIPTION OF THE DRAWINGS

In the drawings, wherein like numerals refer to similar components:

FIG. 1 is a plan view of a dispenser.

FIG. 2 is a vertical sectional view taken along line 2-2 in FIG. 1, depicting an upright coreless roll of paper towels disposed within the dispenser, and a low-reserve indicating mechanism according to the present invention.

FIG. 10 is a fragmentary vertical sectional view taken through the dispenser of FIG. 1 with the indicator mechanism associated with a first roll of paper towels;

FIG. 11 is a view similar to FIG. 10 after the indicator mechanism has indicated that the remaining quantity of towels in the roll is low.

FIG. 12 is a view similar to FIG. 10 wherein the dispenser contains a roll of paper towels having a smaller outer diameter than the roll of FIG. 10.

FIG. 15 is a view similar to FIG. 10 showing an alternative form of indicator mechanism.

DETAILED DESCRIPTION OF THE PREFERRED EMBODIMENTS

Figure 3:
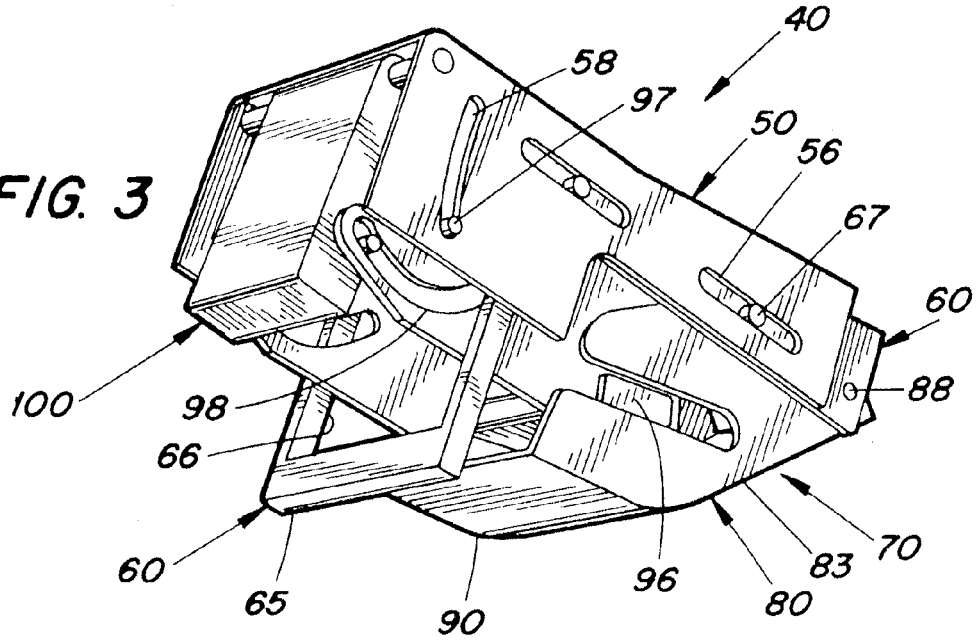
FIG. 3 is a bottom front perspective view of a low reserve indicator mechanism according to the present invention.
Figure 4:
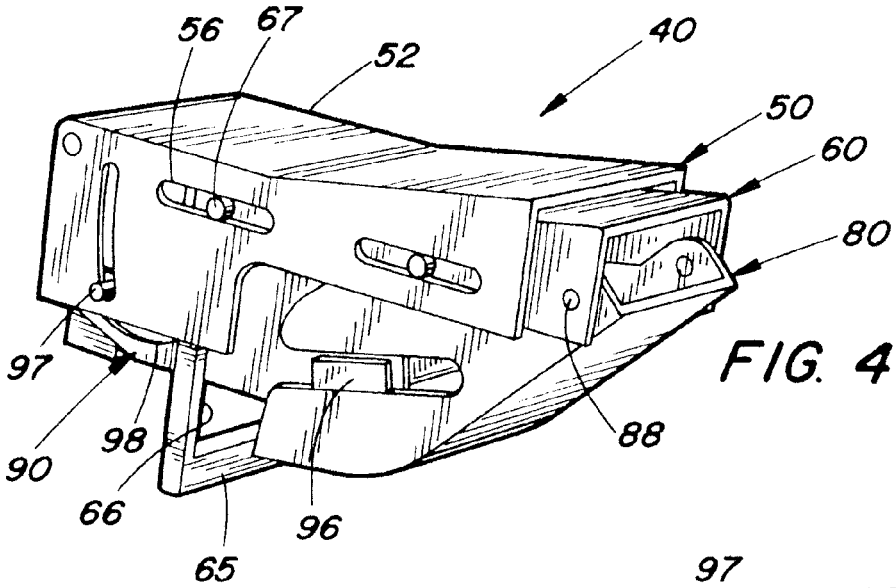
FIG. 4 is a rear top perspective view of the indicator mechanism depicted in FIG. 3.
Figure 5:
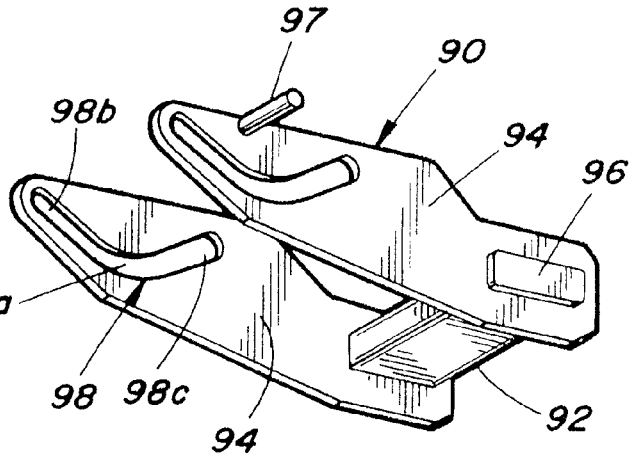
FIG. 5 is a bottom front perspective view of a release portion of a release mechanism according to the present invention.

Depicted in FIGS. 1 and 2 is a paper towel dispenser 10 which dispenses towels from a paper supply in the form of a coreless roll 16 of paper towels from an inner periphery 12 of the roll 16. The dispenser housing includes an upright side wall 18, a floor 20, and a cover 21, together forming an internal chamber 14 for housing the roll 16. The floor 20 includes a central opening 22 through which the towels can be dispensed.

A rear side of the dispenser is to be affixed to a wall 24, so that the central opening 22 is spaced from the wall. In a conventional manner, the dispenser 10 is split into front and rear sections 26, 28 about a vertical parting line, and the dispenser is hinged at 30 along a vertical side of the parting line, to enable the generally semi-cylindrically shaped front section 26 to be swung open about that hinge, whereby the roll 16 can be inserted. Afterwards, the centermost towel is pulled partially down through the opening, and the front section 26 is closed, whereupon the dispenser is ready to dispense. A releasable latch 31 of any suitable type is provided for securing the front and rear sections 26, 28 a closed state.

As the roll 16 becomes depleted, its radial thickness t becomes gradually diminished. In order to warn a user or custodian when the remaining number of towels in the roll reaches a low state, the low-reserve indicator 40 (also herein referred to as a "low reserve indicator mechanism") is provided.

Figure 6:
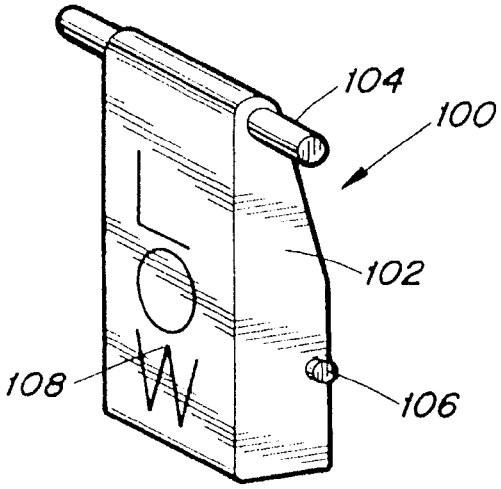
FIG. 6 is a front perspective view of an indicator sign of the indicator mechanism.
Figure 7:
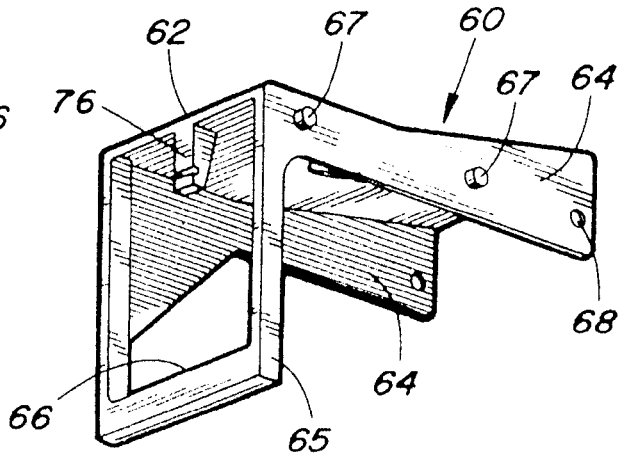
FIG. 7 is a front bottom perspective view of a pusher member of the indicator mechanism.
Figure 8:
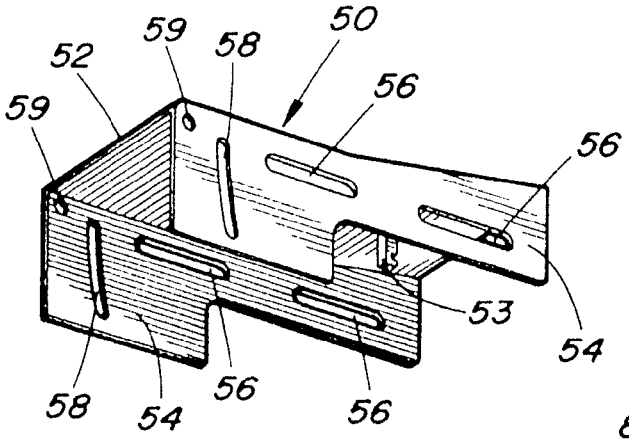
FIG. 8 is a front bottom perspective view of a base member of the indicator mechanism.
Figure 9:
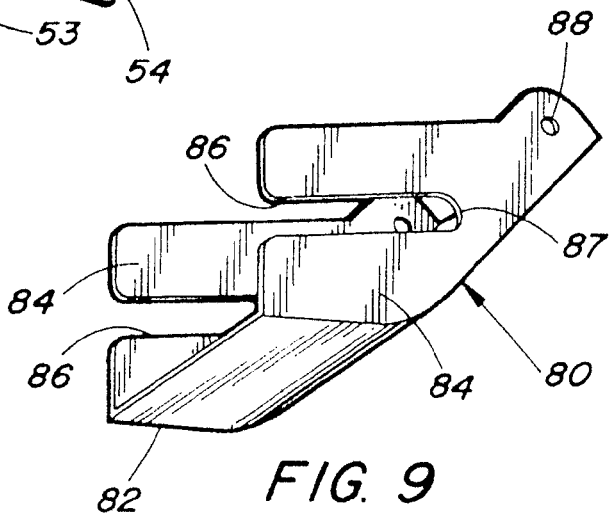
FIG. 9 is a front bottom perspective view of a supporting portion of a release mechanism of the indicator of mechanism.

A first embodiment of the indicator 40, depicted in FIGS. 2-11, comprises an upper housing 50 (FIG. 8), a pusher member 60 (FIG. 7), a release mechanism 70 including a release arm 80 (FIG. 9) and a release slide 90 (FIG. 5), and an indicator in the form of a sign 100 (FIG. 6).

Figure 13:
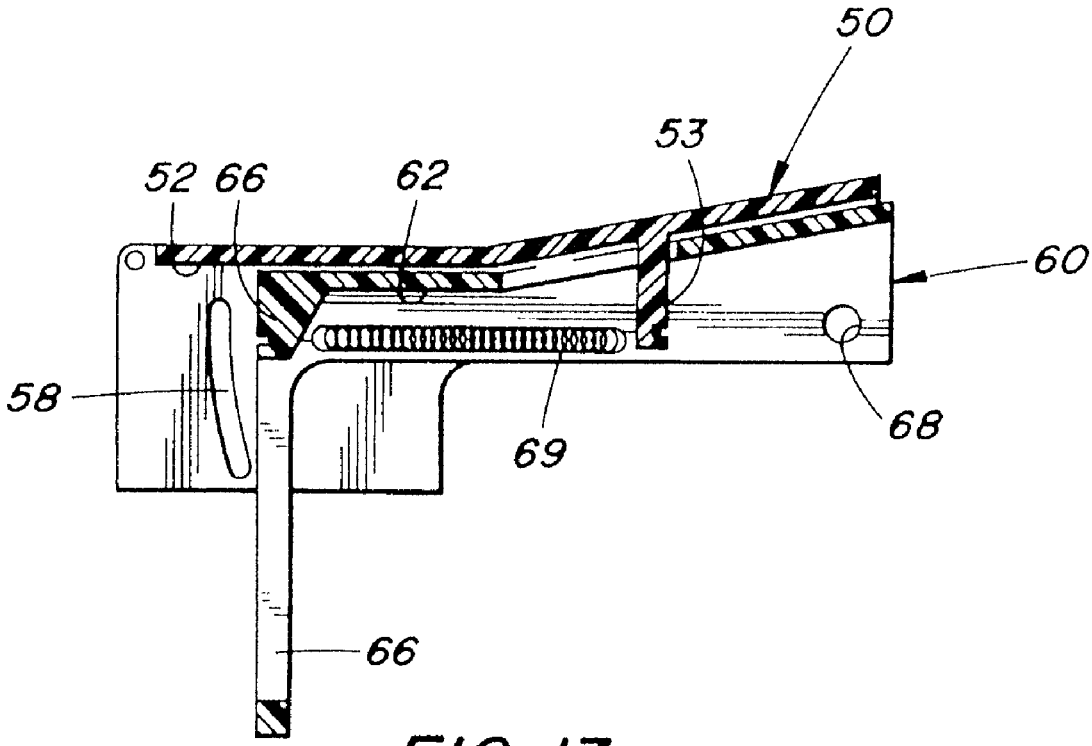
FIG. 13 is a sectional view taken through two components of the low reserve indicator mechanism.

The upper housing or base 50 (FIG. 8) is adapted to be fixed to an underside 26*a* of the dispenser, for example, by a double-backed adhesive (not shown) which can be attached to a top wall 52 of the upper housing 50. Depending downwardly from the top wall 52 are two identical parallel side walls 54, each including a pair of horizontal guide slots 56, a curved, generally vertical guide slot 58, and a pivot hole 59. The guide slots 56 and 58 of each side wall 54 are horizontally aligned with respective slots of the other side wall 54. Also depending from the top wall 52 is a leg 53 adapted to support a rear end of a coil spring 69 (FIG. 13), as will be discussed.

The pusher member 60 (FIG. 7) includes a top wall 62 disposed beneath the top wall 52 of the upper housing 50, a pair of side walls 64 disposed parallel to, and inside of, the side walls 54 of the upper housing, and a front pusher arm or wall 65 depending downwardly from a front end of the top wall 62 and side walls 64. The pusher arm 65 includes an aperture 66 for accommodating movement of the sign 100, as will be explained. Projecting outwardly from the exterior surface of each of the side walls 64 are two guide pins 67. Those guide pins 67 are slidably received in respective horizontal slots 56 of the upper housing 50 to define a pin-and-slot connection to enable the pusher member to slide relative to the base. A pivot hole 68 is situated at a rear end of each side wall 64 to support the release arm 80 of the release mechanism 70. Depending downwardly from a front end of the top wall 62 is a leg 76 that supports a front end of the spring 69. It will be appreciated that the spring 69 yieldably biases the pusher member toward the center of the housing for reasons to be explained.

The release arm 80 (FIG. 9) includes a bottom wall 82 and two side walls 84 extending upwardly from the bottom wall 82. The bottom wall 82 includes a rearwardly facing portion 83 which extends generally upwardly and rearwardly to enable the release arm to be cammed upwardly upon engaging a roll of paper towels when the dispenser is closed, as will be explained. Each side wall 84 includes a guide slot 86 extending in a generally front-to-rear direction. A front end of each guide slot 86 is open, whereas a rear end 87 thereof is closed. Each side wall 84 includes a hole 88 aligned with the respective pivot hole 68 of the pusher member 60, whereby an axle 89 (FIG. 12) can be inserted through the holes 68, 88 to establish a pivot connection enabling the release arm 80 to pivot up and down. The front end of the release arm 80 is thus able to move up and down. One or more torsion springs 91 (see FIG. 12) are provided at the axle 89 to yieldably bias the release arm for counter-clockwise rotation as viewed in FIG. 12.

The release slide 90 (FIG. 5) includes side walls 94 and a connector 92 interconnecting rear ends of the side walls 94. Projecting outwardly from a rear end of each side wall 94 is a guide projection in the form of a rectangular-shaped pin or lug 96 that is slidably disposed in the respective slot 86 of the release arm 80 to define therewith a pin-and-slot connection. A projection in the form of a guide pin 97 projects laterally outwardly from each side wall 94 at a location forwardly of the guide pin 96. The guide pins 97 extend through respective guide slots 58 of the upper housing 50 to define therewith a pin-and-slot connection. Formed in the side wall 94 forwardly of the guide pin 97 is a slot 98 of generally U-shape. The slot 98 includes a central apex portion 98*a* and front and rear portions 98*b*, 98*c* extending generally upwardly from the apex portion.

Figure 14:
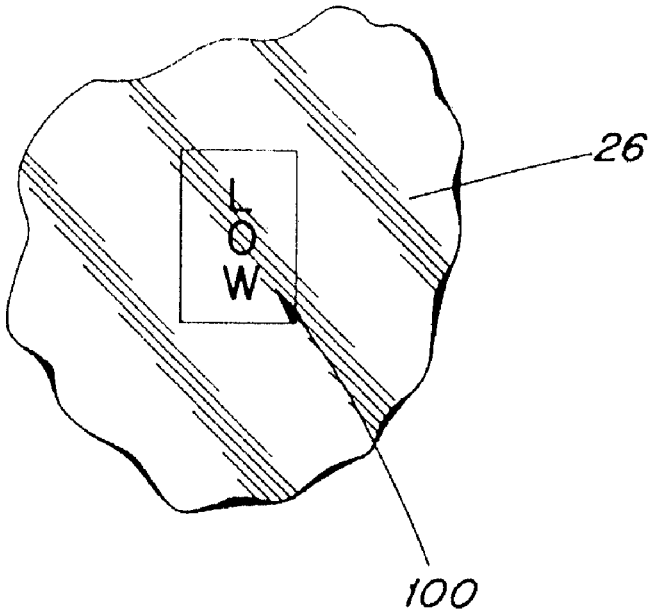
FIG. 14 is a fragmentary view of a sidewall of the dispenser taken in the direction of arrow A in FIG. 2, when the low reserve indicator mechanism indicates that the remaining quantity of paper towels on the roll is low.

The sign 100 (FIG. 6) includes a body 102 having a pair of laterally projecting pivot pins 104 mounted in respective ones of the pivot holes 59 of the upper housing to enable the sign 100 to swing between a rear (retracted) position (FIG. 10) and a forward or indicating (extended) position (FIG. 11). The sign also carries pins 106 disposed in the slots 98 to form therewith a pin-and-slot connection. A front face 108 of the sign 100 carries indicia, such as the word "LOW" which is visible to a user or custodian when the sign is in the forward position (see FIG. 14).

To enable the indicia to be visible, the front section 26 of the dispenser housing is preferably formed of a transparent material, such as a tinted acrylic. Alternatively, a window could be formed in the front section 26 through which the indicia could be seen.

In operation, the coreless roll 16 of paper towels is mounted in an upright state within the internal chamber 14 of the dispenser. When the front section 26 of the dispenser is then closed, the indicating mechanism (which is fixed to the underside 26*a* of the front section 26 of the dispenser) approaches cylindrical outer periphery of the roll 16. In this state, the pusher member 60 will be in its right-most position, that is, closest to the center of the dispenser, under the urging of the spring 69 (see FIG. 13). Also, the release arm 80 will be in its lowermost position, due to gravity, aided by the force of the torsion spring 91 (FIG. 12). As a result, the inclined rearwardly facing portion 83 of the bottom wall of the release arm 80 of the release mechanism 70 abuts an upper edge 16*a* of the roll 16 and is cammed upwardly thereby. Hence, the release arm 80 is caused to pivot upwardly against the bias of the torsion springs 91 about a pivot axis defined by the axle 89. Eventually, the release arm 80 comes to rest on an upper surface 16*b* of the roll 16, as shown in FIG. 10.

It will be appreciated that the release mechanism accommodates rolls of varying height (that is, longitudinal length), because of the ability of the release arm 80 to pivot upwardly. That is, the extent to which the release arm swings upwardly will be dependent upon the height of the roll 16. The greater the roll height, the greater will be the distance by which the release arm 80 swings upwardly.

When the front pusher arm 65 of the pusher member 60 abuts an outer periphery 16*c* of the roll 16 it may be pushed radially outwardly thereby, against the bias of the spring 69 (FIG. 13), by a distance dependent upon the diameter of the roll 16. In the embodiment according to FIGS. 10-11, the roll 16 of maximum diameter has been installed, whereby the pusher member 60 has been displaced to its maximum outer position wherein the guide pins 67 of the pusher member 60 are disposed at the front end of the guide slots 56 of the base.

If the roll 16 had been of a smaller outer diameter, as depicted in FIG. 12, wherein a smaller diameter roll 16' has been installed, the pusher member 60 (FIG. 3) would not have been displaced radially outwardly (that is, to the left) as far as in FIGS. 10 and 11. Also, the guide pins 96 of the release slide 90 would be situated farther outwardly (to the left) in the guide slots 86 of the release arm 80 in FIG. 12. Thus, the reason for making the release mechanism 70 of two parts 80 and 90 is to enable rolls of different outer diameter to be accommodated.

In any event, it will be appreciated that since the release arm 80 is mounted on the pusher member 60, the final position of that release arm 80 is dependent upon the final position of the pusher member 60.

In the state shown in FIG. 10, the guide pins 106 of the sign are captured in the rear portion 98*c* of the guide slots of the release slide 90, and the sign 100 is held in the rear (retracted) position.

As towels are removed from an inner periphery 16*d* of the roll, the radial thickness t of the roll diminishes. Eventually, the inner periphery reaches a lowermost portion 82*a* of the bottom wall 82 of the release arm 80, whereafter an inclined, forwardly facing portion 85 of the release arm 80 contacts the upper rear edge 16*e* of the roll 16. Eventually, the thickness t' is so thin, for example, one-eighth of an inch, that the upper edge 16*a* of the roll travels radially outside of a front end of the forwardly facing portion 85. Accordingly, the release arm becomes unsupported and drops downwardly about the axis of the pivot pins, due to gravity (see FIG. 11). As that happens, the release slide 90 swings downwardly with the release arm, whereupon the guide slots 98 force the guide pins 106 of the sign 100 forwardly until the sign comes to rest in the forward position, so that the user or custodian can see the "LOW" indicia (see FIG. 14).

It will be understood that since the release arm 80 is mounted on the pusher member 60 and moves together therewith, the distance between the pusher arm 65 and the roll-contacting point on the bottom wall 82 of the release arm 80 will remain essentially constant during the towel dispensing phase, regardless of the horizontal location of the pusher member 60, that is, regardless of the outer diameter of the roll. Thus, the sign 100 will always provide a low reserve indication in response to the same value of t'.

It will be appreciated that the low-reserve mechanism according to the present invention enables a user or custodian to be warned of a low-reserve state of an upright roll of paper towels in a dispenser. Furthermore, the low-reserve mechanism automatically adjusts to the height and outer diameter of the upright roll.

Also while it has been mentioned that springs can be provided to bias the release arm 80 downwardly, it may be possible to dispense with those springs and rely upon gravity alone if the design is such that insufficient friction will be generated that could cause the release arm to become hung-up.

It will also be appreciated that the feature of the invention wherein the low-reserve mechanism automatically adjusts to the roll diameter is optional. That is, the release mechanism, instead of being formed of two relatively movable parts 80, 90, could be formed of a single member, as shown in FIG. 15. That is, FIG. 15 shows an indicating mechanism 40' wherein the release mechanism 70' comprises a single element pivotably connected to a stationary upper housing 50' which also carries a pusher member 65' that abuts the outer periphery of the roll 16. The release mechanism 70' carries guide slots 98' in which guide pins 106' of the sign 100' slide. The indicator mechanism accommodates a roll of a given outer diameter and does not possess the ability to accommodate rolls of different outer diameter as does the mechanism of FIGS. 1-14.

Figure 16:
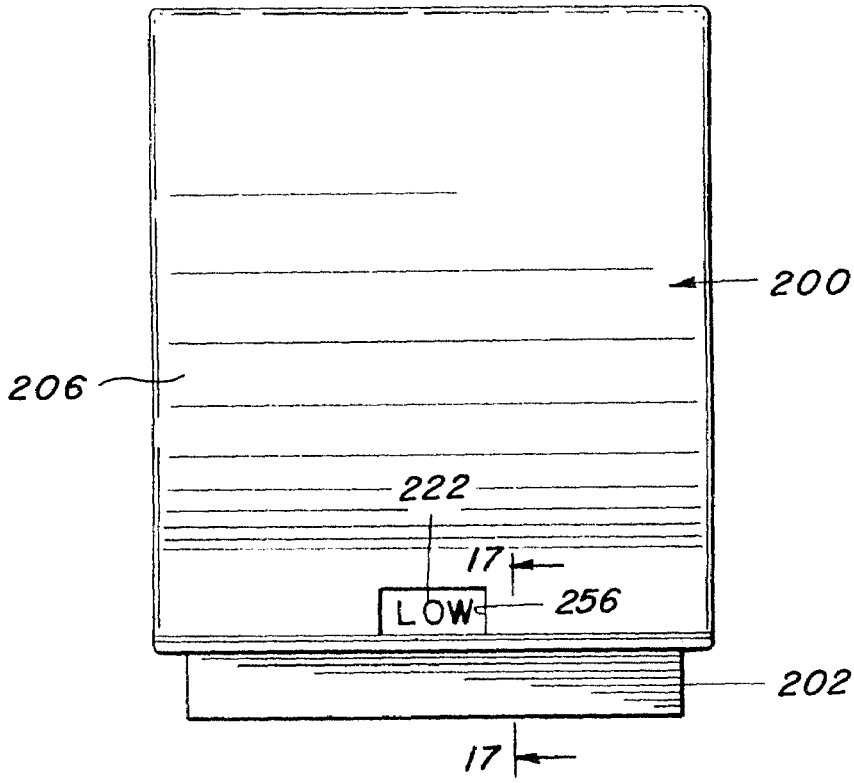
FIG. 16 is a front elevational view of a paper towel dispenser of the type which dispenses towels from a vertical stack, the dispenser containing a low reserve indicator according to the invention.
Figure 17:
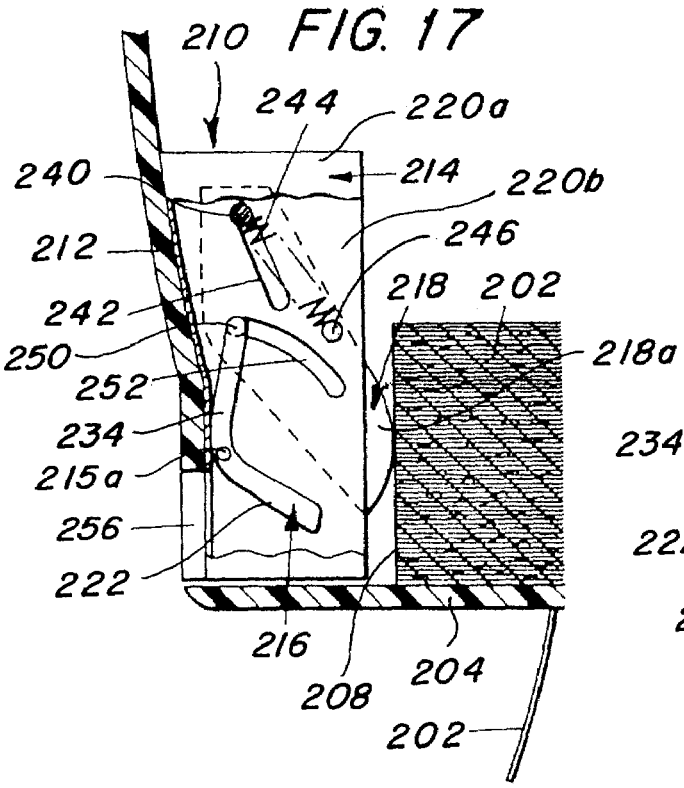
FIG. 17 is a sectional view taken along line 17-17 in FIG. 16 showing the low-reserve indicator in a retracted position.
Figure 18:
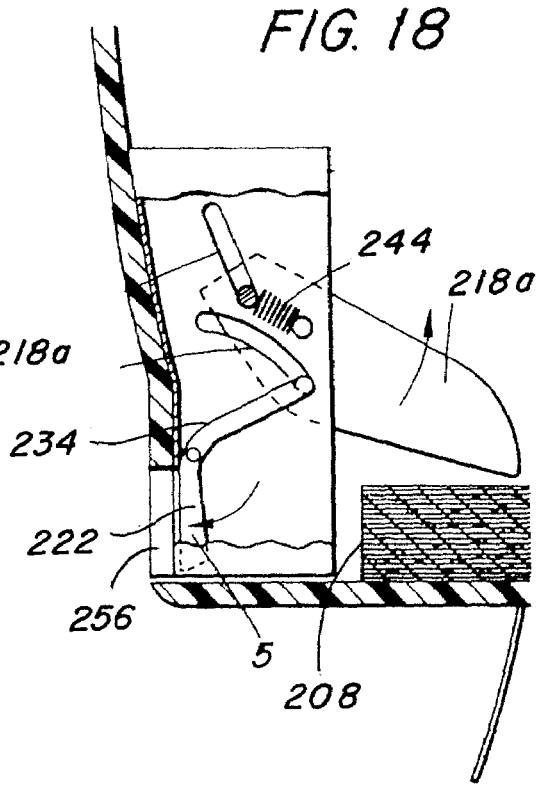
FIG. 18 is a view, similar to FIG. 17, after a release mechanism of the indicator has been released in response to the paper stack descending below a predetermined level.

The present invention can also be used to provide a low-reserve indication for towel dispensers of the type in which towels are dispensed from a paper supply in the form of a vertical stack or a horizontal roll. In that regard, attention is directed to FIGS. 16-18 depicting a dispenser housing 200 of the type which dispenses paper towels 202 disposed in a vertical stack. The dispenser includes a fixed first section 204 that is fixed to a wall (not shown), and a hinged second section (door) 206 that is connected to the first section 204 by a hinge (e.g., along an upper edge or a vertical side edge) to open and close a chamber formed by the dispenser housing. The stack of towels 202 (preferably interfolded towels) is supported such that at each end of the stack, vertically superimposed edge portions of the towels form a vertical side 208 that faces in a horizontally outward direction. The housing also forms a dispensing aperture at a lower end of the chamber for dispensing towels one-at-a-time.

A low-reserve indicator mechanism 210 according to the invention is affixed within the chamber to an upright wall 212 defined by the door 206 for indicating when a remaining (reserve) quantity of towels in the stack is low. The indicator mechanism includes a base member 214 affixed to the upright wall 212, an indicator 216 mounted to the base member 214 for rotation about a horizontal axis 215*a*, and a release mechanism 218. The base member is similar to the previously described upper housing 50 in that it includes a pair of parallel side walls 220*a*, 220*b*. The indicator 216 includes a sign 222 that bears the indicia "LOW", and a crank arm 234. The release mechanism comprises pair of parallel arms 218*a* (only one arm being depicted) interconnected by a pin 240.

The side walls 220*a*, 220*b* of the base member 214 are situated between the arms 218*a*, and the indicator 216 is situated between the side walls 220*a*, 220*b*. The pin 240 is slidably and rotatably disposed in identical first slots 242 formed in respective side walls 220*a*, 220*b* and is spring-biased in a direction of bias by tension springs 244 (only one shown), each of which extends between the pin 240 and a fixed joint 246 on the respective side wall 220*a*, 220*b*.

The crank arm 234 of the indicator 216 is pivotably connected to respective ones of the arms 218*a* by respective pin-and-slot connections, and defined by a pin 250 that extends through a second slot 252 formed in the respective side wall 220*a* or 220*b*.

In use, an operator opens the door 206, inserts a new stack of paper towels 202, and re-closes the door. When the door is closed, the arms 218*a* of the release mechanism engage the vertical side 208 of the stack and are pushed to the retracted position shown in FIG. 17, against the bias of the spring 244. Simultaneously, the indicator 216 is swung to a position shown in FIG. 17 wherein the sign 222 is spaced from a window 256 formed in the wall 212. When the stack of towels becomes so depleted that the vertical side 208 of the stack descends to a level below the arms 218*a*, the arms 218*a* are released and swung by the springs 244 to a release position shown in FIG. 18 in a direction causing the sign 222 to be swung toward the window 256 in order to expose the "LOW" indicia as shown in FIG. 16.

Figure 19:
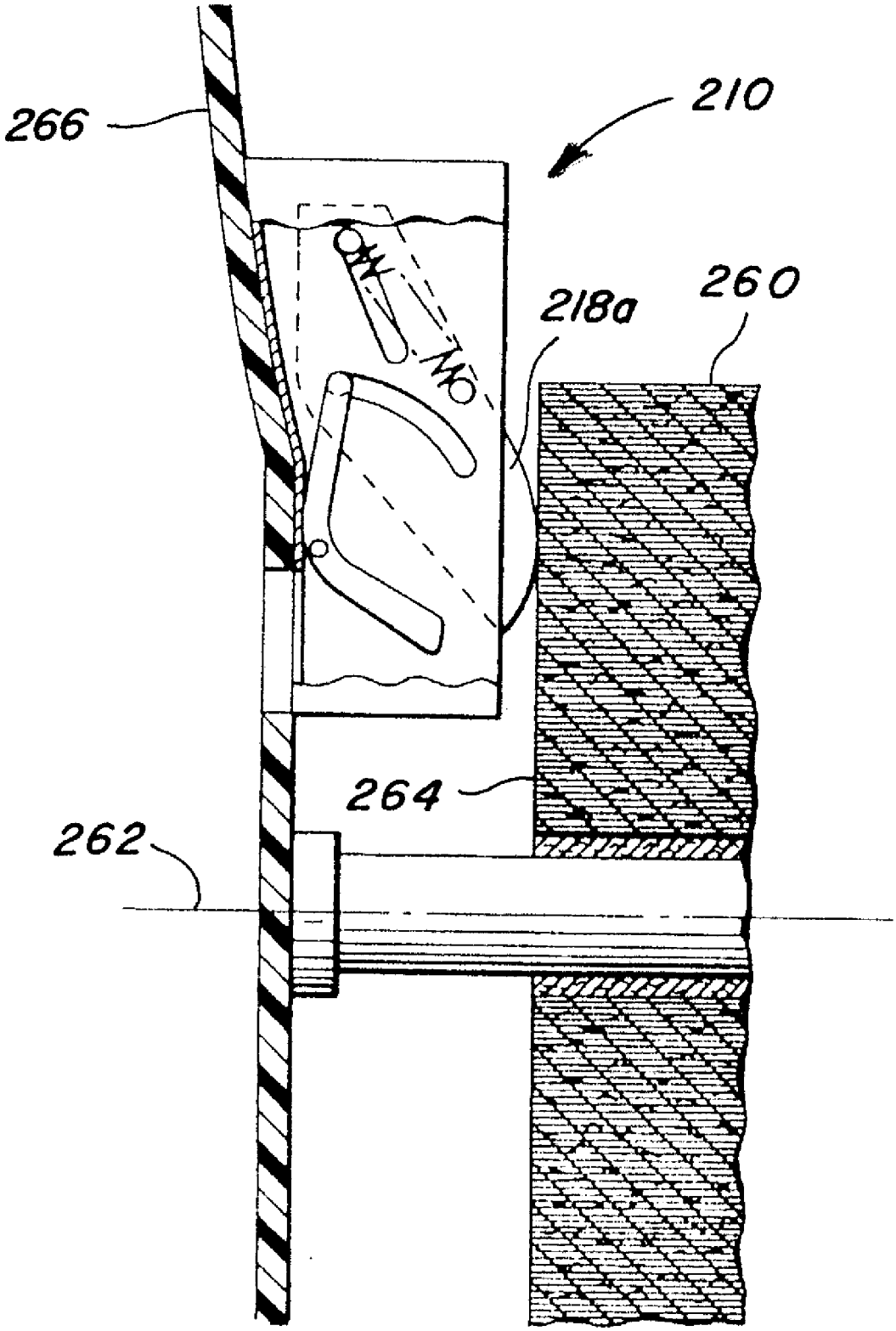
FIG. 19 is a view similar, to FIG. 17, of a dispenser of the type which dispenses towels from a horizontal roll.

The low-reserve indicator mechanism 210 can also be used in connection with a conventional dispenser that dispenses towels from a roll of paper towels 260 which rotates about a horizontal axis 262, as shown in FIG. 19. The towels are separated from the towels 260 by the user, for example, by forcing the paper against a conventional cutter (not shown) formed on the dispenser housing. The paper in the roll has vertically superimposed edge portions that form a vertical side 264 that is contacted by the arms 218*a* of the release mechanism in the manner disclosed above. When the roll is depleted to such an extent that the vertical side 264 descends below the point of contact with the arms 218*a*, the "LOW" indicia of the sign 222 becomes visible outside of the dispenser housing. A wall 266 shown in FIG. 19 could be a side wall of the dispenser housing. The arms 218*a* could be automatically pushed to the retracted position in response to the application of a force thereto from the towels 260 as the roll is being loaded.

The low-reserve indicator is small light-weight, inexpensive and can be automatically placed in a retracted state in response to the loading of paper, or closing the dispenser.

It will also be appreciated that the low-reserve indicator mechanism 210 could assume many different configurations for achieving its intended advantages.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A paper dispenser comprising:

a housing having an inner chamber configured to support a stacked paper supply and a dispensing aperture for dispensing paper from the paper supply, the paper supply having a side formed by superimposed edge portions of paper in the paper supply; and an indicator mechanism affixed to the housing within the inner chamber adjacent and paper supply, the indicator mechanism comprising:

an indicator movable between a retracted position and an indicating position, and a release mechanism operably connected to the indicator and pivotally biased toward the side formed by superimposed edge portions of paper in the paper supply, the release mechanism being releasable in response to the paper supply being reduced below a predetermined amount, wherein upon being released the release mechanism causes the indicator to move to the indicating position.

2. The paper dispenser of claim 1, wherein prior to being released the release mechanism engages the side formed by superimposed edge portions of paper in the paper supply, and upon being released the release mechanism does not engage the side formed by superimposed edge portions of paper in the paper supply.

3. The paper dispenser of claim 1, wherein the stacked paper supply comprises interfolded napkins disposed within the housing so as to be dispensable via the dispensing aperture one-at-a-time.

4. The paper dispenser of claim 3, wherein the dispensing aperture is disposed at a lower end of the inner chamber so as to dispense the napkins in a downward gravity-feed direction.

* * * * *